United States Patent [19]

Norris et al.

[11] 4,236,477

[45] Dec. 2, 1980

[54] BOAT HULL CLEANING DEVICE

[75] Inventors: Thomas E. Norris, Spokane, Wash.; Bertle Spence, Moscow, Id.

[73] Assignee: Water Front Products, Inc., Oakesdale, Wash.

[21] Appl. No.: 45,015

[22] Filed: Jun. 4, 1979

[51] Int. Cl.[3] ..... B63B 59/08

[52] U.S. Cl. ..... 114/222

[58] Field of Search ..... 114/222; 15/1.7, DIG. 2

[56] References Cited

U.S. PATENT DOCUMENTS

| | | | |
|---|---|---|---|
| 3,227,124 | 1/1966 | Campbell | 114/222 |
| 3,561,391 | 2/1971 | Locati | 114/222 |
| 3,688,328 | 9/1972 | Wilkins | 15/DIG. 2 X |
| 3,709,184 | 1/1973 | Laney | 114/222 |
| 3,750,212 | 8/1973 | Bernardi et al. | 15/DIG. 2 X |
| 3,752,109 | 8/1973 | Seiple | 114/222 |
| 3,800,732 | 4/1974 | Hill | 15/DIG. 2 X |
| 4,043,286 | 8/1977 | Doty | 114/222 |
| 4,046,095 | 9/1977 | Fike | 114/222 |

FOREIGN PATENT DOCUMENTS

| | | | |
|---|---|---|---|
| 1580082 | 5/1970 | Fed. Rep. of Germany | 15/DIG. 2 |
| 27048 | 11/1964 | German Democratic Rep. | 114/222 |
| 1136186 | 12/1968 | United Kingdom | 15/DIG. 2 |

*Primary Examiner*—Sherman D. Basinger
*Attorney, Agent, or Firm*—Wells, St. John & Roberts

[57] ABSTRACT

A device for progressively cleaning the hull of a boat being moved forwardly along a prescribed path. The device includes a submersed stationary support frame. A hull cleaning framework is mounted to the support frame and is elevationally movable thereon between a partially submerged operative condition, and an above surface inoperative condition. A number of brush supporting arms are pivoted on the hull cleaner framework and extend along the path of a boat through the device at their outer ends. The arms are biased inwardly toward the path for yieldably urging the rotating brushes against the boat hull regardless of its configuration. The device will automatically adapt itself to a wide variety of power boat and sailboat hull shapes. Vertical brushes are provided to clean the downwardly projecting keels of sailboats. Transverse bottom, intermediate and side brushes are independently pivoted to accommodate sailboat hulls or many other forms of boat hulls. The keel, bottom, intermediate and side brushes transversely overlap each other to clean adjoining longitudinal sections of a boat hull regardless of the hull shape.

13 Claims, 7 Drawing Figures

BOAT HULL CLEANING DEVICE

BACKGROUND OF THE INVENTION

The present invention is directed to an apparatus for automatically cleaning the hull of a floating boat.

The submersed parts of a boat hull will eventually build up a film of bacterial growth or mineral residue along the hull surfaces that can substantially detract from the overall performance of the vessel as well as its appearance.

Various hull cleaning apparatus have been developed in the past that function serviceably to clean a limited variety of hull configurations. It remains desirable, however, to obtain some form of cleaning device that will function efficiently to clean the hulls of power boats with shallow keels and sailboat hulls which typically include large vertically downward projecting keels.

U.S. Pat. No. 3,561,391 granted to Locati in 1971 discloses the use of two sets of brushes for cleaning the bottom of a boat. The brush supports are hinged on side frames, outward of the boat's path. Biasing mechanisms urge the brushes against the hull of a boat that is being moved past. The cleaning arrangement is mounted on pontoons which float at the water surface. Repair of the device must be completed either on the floating arrangement or by elevating the entire cleaning arrangement to facilitate access to the brushes and drive mechanisms that would normally be submerged or directly adjacent to the water surface. No independent specific provision is made for cleaning the downwardly projecting keels of sailboats.

U.S. Pat. No. 3,227,124 to Campbell shows powered brushes for cleaning the bottom surfaces of small boats. The brushes are yieldably urged against the bottom hull surfaces from pivot points alongside of the boat as the boat is being pulled through the apparatus. Vertical support columns are provided mounting the brushes for elevational adjustment. Again, no particular provision is made for the cleaning of sailboat keels.

U.S. Pat. Nos. 3,752,109 to Seiple and 4,043,286 to Doty both describe U-shaped frame apparatus having side brushes and bottom brushes pivoted from sides of supporting frames for engaging a boat hull. Seiple includes provisions for adjusting the pressure on the boat hull in an even application. Doty shows two independently rotating brushes (pivoted on sides of the frame outward of the boat's path) for cleaning the hull bottom surfaces and longitudinally spaced side brushes for cleaning the side surfaces of a boat.

A boat hull cleaning device that includes provisions for cleaning the keel of a sailboat is illustrated in the Laney U.S. Pat. No. 3,709,184. Laney makes use of a conveyor belt brush arrangement that is yieldable along its laterally oriented operating flight to accommodate the hull and keel of a sailboat. Two endless belts are provided, one for cleaning each longitudinal side of a sailboat hull. The conveyor flights converge at the center line of the hull to move downwardly to the bottom of the keel. A gap formed at the beginning of the vertical keel cleaning portions of the flights would leave a similar uncleaned gap along the keel portions of a power boat.

An alternate form of the disclosure in U.S. Pat. No. 3,709,184 makes use of horizontally biased cylindrical brushes. The brushes are situated in vertically spaced positions along a carrying frame. Rotational axes for the brushes run parallel to the path of the boat through the cleaning device. The brushes appear able to clean narrow longitudinal strips of a boat hull but would likely leave a longitudinal keel strip uncleaned along a standard power boat hull.

Of the above devices, all that make use of pivoted arm arrangements for supporting rotatable hull cleaning brushes operate effectively only within a restricted size range and variety of hull configurations. The brush arms are pivoted at the sides of the boat's path through the device so the brushes must pivot laterally away from the path when larger hulls are encountered. The brushes thus spread will no longer overlap one another transversely and will only clean individual strips along the engaged hull surface, leaving wide swaths uncleaned.

The present device includes brush arms that are mounted on pivot axes that are situated directly below the path so the associated brushes will merely pivot up and down while remaining in a transversely overlapping relationship across the hull path.

DETAILED DESCRIPTION OF A PREFERRED EMBODIMENT

Figure 1:
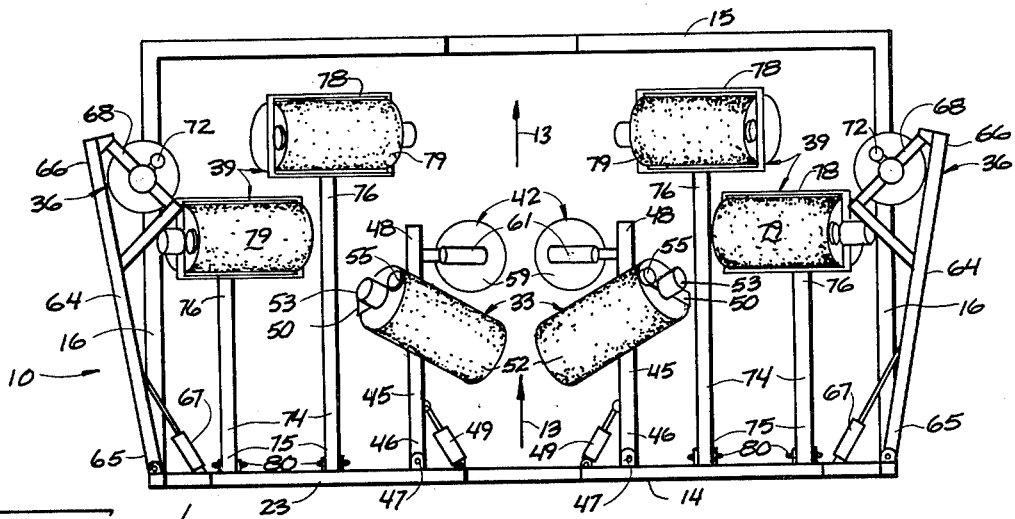
FIG. 1 is a plan view of the present device.

A preferred form of the present boat hull cleaning device is generally indicated in the drawings by the reference numeral 10. The device is utilized for cleaning the hull 12 of a boat such as the sailboat illustrated in dashed lines at 11. Cleaning is accomplished progressively as the boat is moved along a prescribed path 13 (FIGS. 1 and 7) in a forward direction of travel. The path leads from a transverse back end 14 through a transverse front end 15 of the device. The transverse ends 14, 15 are joined by longitudinal sides 16. Several cylindrical brushes clean the forwardly moving boat hull by the scrubbing action of rotating resilient bristles.

Figure 2:
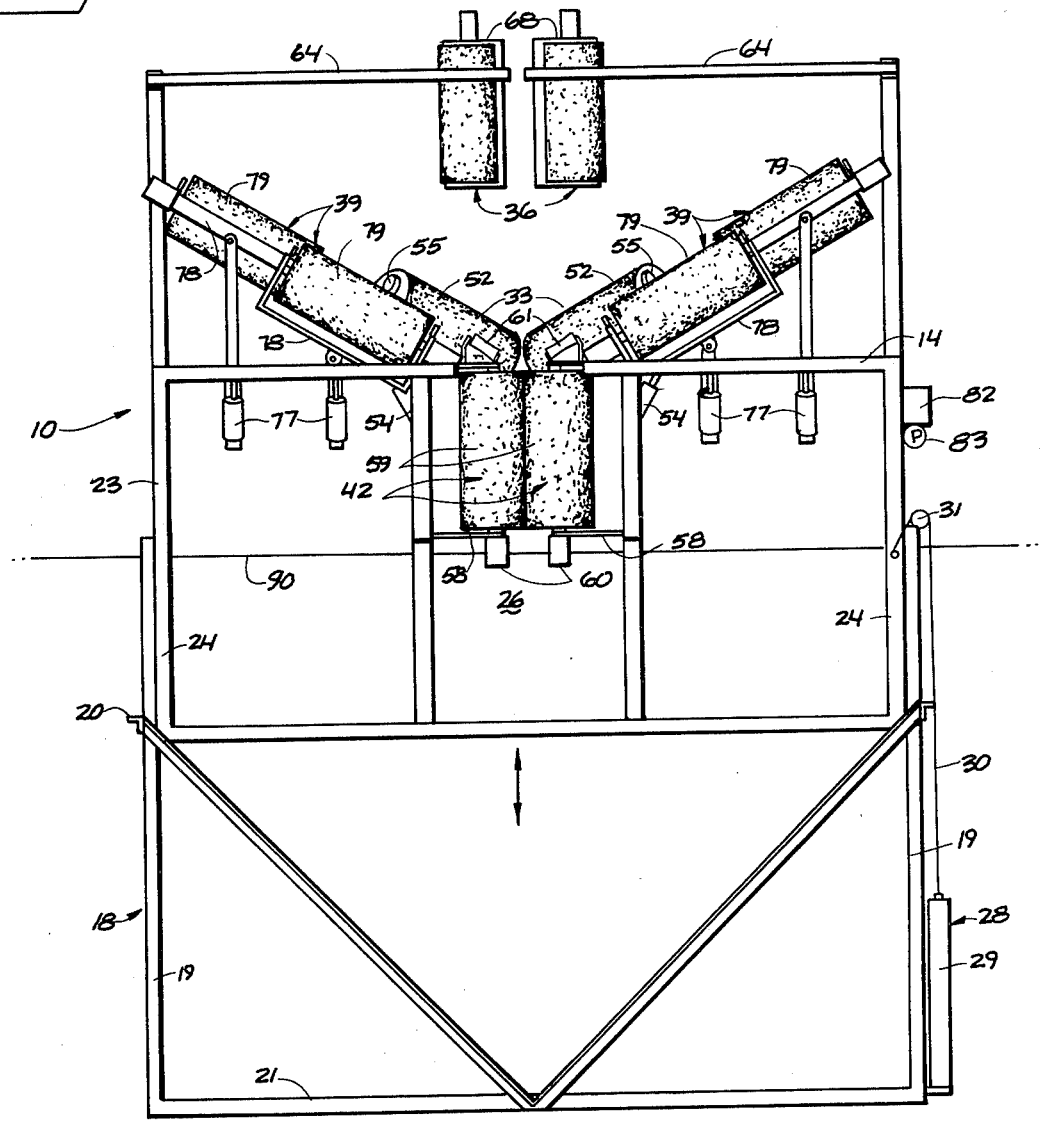
FIG. 2 is an elevational front end view of the device showing the hull cleaning frame in an elevated inoperative position and with the hydraulic system actuated.

The present device may be secured to the ground surface below a body of water by a stationary supportive framework 18. The supportive framework 18 includes a number of upright legs 19 supporting a top frame section 20 (FIG. 2). A bottom frame section 21 is located at the bottom ends of the legs. The supportive framework 18 may rest directly on the bottom surface. However, it is preferably secured to the pilings of a dock or pier. Appropriate fasteners (not shown) may be secured along the length of the upright legs 19 to fix the frame to such pilings.

A hull cleaner frame 23 is movably mounted to the supportive framework 18. The cleaner frame 23 includes upright legs 24 that are parallel to the stationary legs 19. A central longitudinal recess or passageway 26 is formed along the movable framework 18 between legs 24 to allow free passage of a boat hull guided along the path 13.

Figure 3:
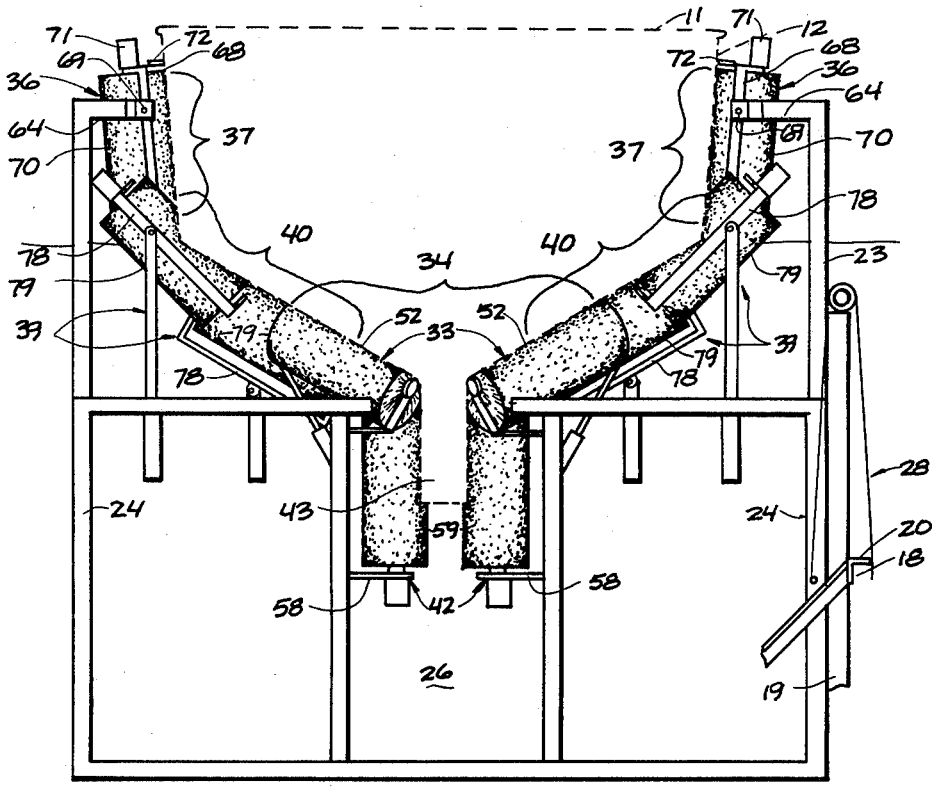
FIG. 3 is an elevational back end view as seen from below in FIG. 1 only with the hull cleaning frame in a lowered operative position and with a boat hull shown in dashed lines therein.

A hoist means 28 is provided to selectively move the frame 23 between an operative hull cleaning position shown in FIG. 3, wherein the frame 23 is at least partially submerged and an above surface inoperative position shown in FIG. 2. The hoist means 28 is shown including a cylinder 29 (FIG. 2) fixed to the supportive framework 18. The piston shaft of cylinder 29 is connected by a cable 30 extending over one or more pulleys 31 to the hull cleaner frame 23. Extension and retraction of the cylinder will cause corresponding vertical movement of the hull cleaner frame 23 with respect to supportive framework 18. The illustrated hoist means 28 is exemplary of a preferred form of hoisting arrangement. Other forms may be envisioned including overhead winch arrangements or other mechanisms for moving the hull cleaning frame between the two positions.

Several brush assemblies are mounted to the hull cleaner frame 23 for progressively cleaning transversely overlapping longitudinal sections of a boat hull as it is moved forwardly through the device along the prescribed path 13. A bottom brush assembly 33 is provided for cleaning a bottom longitudinal section 34 (FIG. 3) of a boat hull as it passes by. A side brush assembly 36 is provided for cleaning opposed longitudinal side wall sections 37. An intermediate brush assembly 39 will progressively clean longitudinal intermediate sections 40 that overlap or are overlapped by the sections cleaned by brush assemblies 33 and 36. A keel brush assembly 42 is provided to clean the keel 43 (FIG. 3) of a sailboat in conjunction with operation of the remaining brush assemblies. The keel brush assembly 42 will be inoperative when the device is being used for cleaning various forms of power boat hulls (not having downwardly protruding keels).

All brushes are similar to the variety used in automated car washes, having resilient bristles projecting radially from a central powered shaft. The bristles are trimmed to cylindrical configurations but conceivably could take other shapes.

The bottom brush assembly 33 includes a pair of bottom brush arms 45. The brush arms 45 are pivoted to the hull cleaner framework 23 at inward ends 46. Upright pivot pins 47 interconnect the inward ends 46 with the frame end 14. The pins 47 define vertical pivot axes that are transverse to the path 13 and directly below it. The axes of pins 47 are equally spaced transversely from the center of the path 13. The arms extend forwardly from ends 46 to free outer ends 48. Hydraulic cylinders 49 interconnect the arms 45 and frames 23 for pivoting the arm ends 48 in horizontal axes about the vertical pin axes to yieldably press the bottom brush assemblies upwardly toward a boat hull.

The bottom brush arms 45 mount bottom brush yokes 50. The yokes are pivoted at the outer arm ends about axes that are substantially parallel to path 13. Bottom brushes 52 are mounted to the yokes 50 for rotation about axes that are substantially transverse to the yoke pivot axes and are therefore also transverse to the path 13. The brushes are powered to rotate by hydraulic motors 53.

Figure 4:
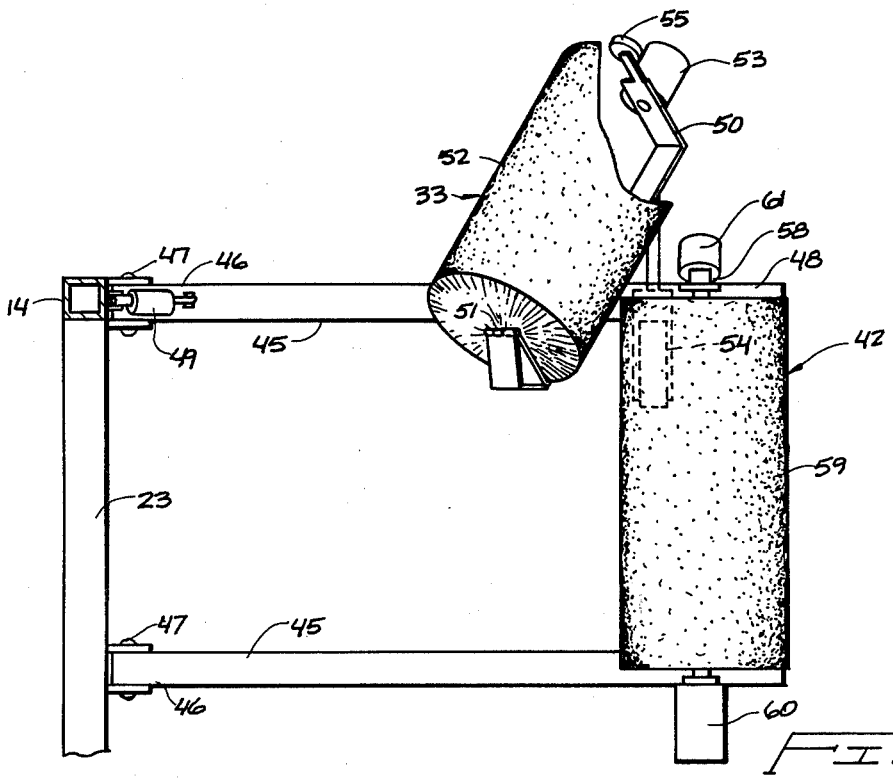
FIG. 4 is an enlarged fragmentary detail view of a keel brush assembly and a bottom brush assembly.
Figure 5:
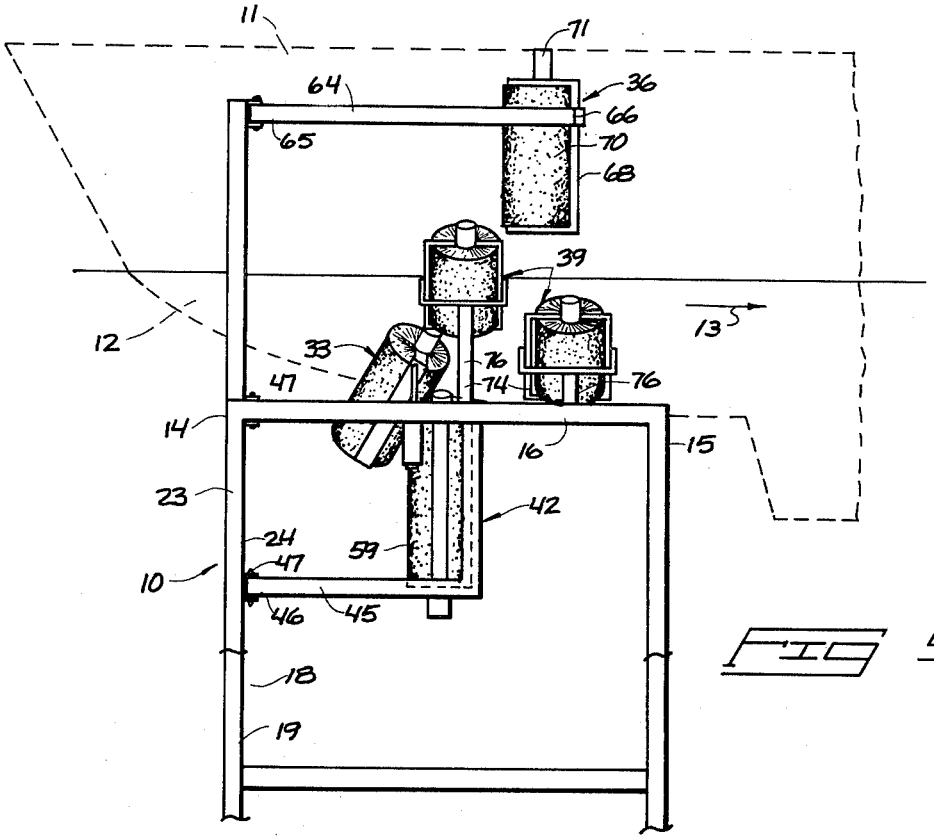
FIG. 5 is a side elevation view as seen from the right in FIG. 3 with a portion of a boat hull shown in dashed lines.
Figure 6:
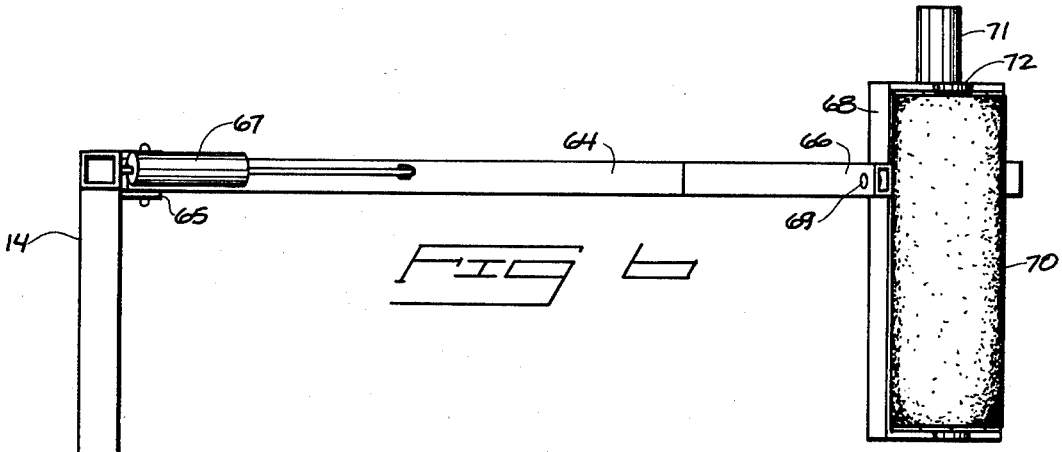
FIG. 6 is a detail view of a side brush assembly.

The yokes 50 are mounted to arms 45 by pivot hinges 51 (FIG. 4). Means is provided at 54 for pivoting the bottom brush yokes upwardly about the axes of the hinges 51 to yieldably urge the brushes 52 about the hinge axes against the adjacent surfaces of a boat hull.

Guide rollers 55 are provided at outward ends of the yokes 50 to engage a boat hull and cause pivotal movement of the brushes about the hinge pivot axes and about the arm pins 47, in response to gradual changes in hull configuration. The rollers 55 will also prevent the yokes from engaging and gouging the adjacent boat hull surface.

The keel brush assembly is also mounted to the bottom brush arms 45. The keel brush assembly 42 includes a pair of keel brush yokes 58. The yokes 58 are fixed at ends 48 of the brush arm 45 directly below inner ends of the bottom brushes 52. Yokes 58 are vertical and extend downwardly a distance corresponding to the length of sailboat keel 43. Yokes 58 rotatably mount keel brushes 59. The keel brushes 59 are powered to rotate about their vertical axes by hydraulic motors 60.

The yokes 58 and keel brushes 59 are mounted to bottom brush arms 45 and so will pivot with the arms inwardly and outwardly with respect to the path 13 to accommodate various sailboat keels. The hydraulic cylinders 49 function to urge the brushes 59 against the passing keel. If there is no downwardly projecting keel on the hull being cleaned, the brushes 59 will be pivoted inwardly with the arms 45 to intersecting, inoperative positions as shown at FIG. 2.

The keel and bottom brushes are fixed relative to one another on the same arms 45 so they can pivot in unison on the arm axes to accommodate either sailboat keels or hulls with shallow keels.

Upper ends of the keel yokes 58 mount boat hull rollers 61 that will effectively prevent engagement of the keel brush yokes 58 with a boat hull. The rollers 61 may be of the type conventionally used on boat hauling trailers.

The side brush assembly 36 is shown in detail by FIGS. 1, 2, 5, and 6. The side brush assembly 36 includes two side brush arms 64 spaced laterally and at equal distances from the path 13. The arms 64 are pivotally mounted to the hull cleaner frame 23 at inward ends 65. They extend forwardly from ends 65 to outward ends 66.

The arm ends 65 pivot in horizontal arcs about vertical axes parallel and outwardly spaced from the bottom brush arms in relation to the path 13. Hydraulic cylinders 67 are provided to urge the outward ends 66 inwardly in arcs toward the prescribed path 13. The arms are shown in FIG. 1 in an outward position and an inward position in FIG. 2.

Each arm 64 mounts a side brush yoke 68 at its outward end 66. The side brush yokes 68 are pivotably mounted at 69 (FIG. 7) to the arms 64. The pivot axes at 69 are horizontal and situated along the height of the yokes 68 slightly above their centers of gravity. The yokes will tend to remain in an upright orientation but will pivot relatively freely about their horizontal axes as the brushes 70 engage the side sections 37 of a boat hull.

Side brushes 70 are rotatably mounted to the yokes 68 and are each driven to rotate about upright axes by a hydraulic motor 71. Guide rollers 72 (FIGS. 1, 3 and 6) on the yokes 68 prevent engagement of the boat hull by the yokes or adjacent rigid elements.

The intermediate brush assembly 39, is situated both elevationally and horizontally intermediate the bottom and side brush assemblies. The intermediate brush assembly includes at least one and preferably two pairs of intermediate brush arms 74 (FIG. 1). The arms 74 extend from ends 75 on the end 14 of the hull cleaner frame 23 forwardly to longitudinally staggered outer ends 76. Hydraulic cylinders 77 (FIG. 2) are mounted between the arms 74 and frame 23. Cylinders 77 pivot the outer arm ends 76 in vertical arcs about the horizontal axes of pins 80 that mount the rearward arm ends to the frame 23. The pivot axes are situated directly below and are transverse to the path 13.

Intermediate brush yokes 78 are situated at the forward arm ends 76 to rotatably mount intermediate brushes 79. The brush yokes 78 are pivotably suspended from arms 74 on horizontal yoke pivot axes. The yoke pivot axes are also substantially parallel to the arms 74 and path 13.

The intermediate yoke pivot axes are over-centered elevationally along the yokes 78 and intermediate brushes 79. The yokes and attached brushes will therefore normally seek upright orientations but will freely pivot to conform with the transverse angular configuration of an engaged section 40 of a boat hull as it moves by. The brushes and yokes 78 and 79 are arranged to overlap one another transversely with respect to the path 13. This assures that the entire width of the intermediate hull section 40 engaged by the brushes 78 and 79 will be cleaned regardless of the hull configuration.

FIG. 2 diagrammatically illustrates a hydraulic supply 82. The supply 82 includes a hydraulic pump 83 for delivering fluid under pressure through appropriate hydraulic lines (not shown) to the various motors and cylinders. The hydraulic lines may be connected to the common source in a relatively open circuit so that actuation of the hydraulic pump 83 will produce fluid flow to all cylinders and motors simultaneously. The pump 83 is of the non-positive displacement form so the cylinders 77, 67, 54 and 49 will yieldably urge the arms inwardly. The brushes will therefore be urged inwardly to exert constant even pressure against the boat hull as it is moved through the device. The arms will yieldably pivot in response to relative change in the hull cross-sectional configuration while the inward force of the arms against the boat hull will remain uniform.

Figure 7:
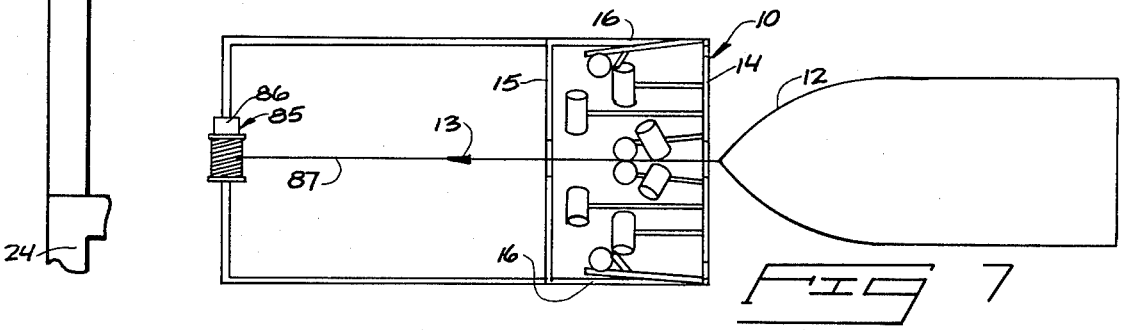
FIG. 7 is a reduced diagrammatic view showing a boat being moved toward the present device.

Boats are pulled through the device along the prescribed path 13 by means generally shown at 85 in FIG. 7. Such means may be comprised of a winch 86 and winchline 87 attached to the bow of a boat. The winchline 87 is preferably centered along the path 13 and is situated at a location beyond the front end 15 of the device.

Means 85 may also be comprised of other mechanical devices that will function to move a boat forwardly along the path 13 at a relatively slow and even rate of speed. The winch or other appropriate device may include a hydraulic drive arrangement connected to the common supply 82 to operate in unison with the remaining hydraulic elements described above.

Prior to operation, the various brush assemblies are found in inoperative positions as shown in FIG. 1. However, upon actuation of the hydraulic system, the cylinders will function to urge the respective arms and brushes toward the prescribed path 13. The brushes will simultaneously begin rotating, preferably in a direction opposing forward motion of the boat through the device.

The winch line 87 is connected to the bow end of a boat and the winch 86 is actuated to pull the boat along the path 13 into progressive engagement with the several brush assemblies.

The bow of the boat will initially engage the side brush assemblies. The bow will cam the side brushes 70 apart as the boat progresses forwardly through the device. The brushes 70 will separate laterally to accommodate the typically diverging hull sides against inward force produced by the cylinders 67. The brushes 70 will therefore remain in operative engagement with the bow and sides of the boat to clean the longitudinal side sections 37 spanned by the length of the brushes engaged against the boat side. The bristles of the brushes 70 will flex, conforming to surface irregularities to entirely clean the sections 37 along the side of the boat. The brushes 70 and yokes 68 holding them will also pivot about the yoke axes in correspondence to angular change along the boat sides.

As the boat initially moves through the device and slightly after the side brushes have been engaged, the intermediate brushes 79 will engage and scrub the boat hull. They will clean the hull along the longitudinal sections 40 below the side sections 37 previously cleaned by the side brushes 70. The intermediate brushes 79 are normally biased upwardly from below the path 13 to first engage the bow of the boat. They will then be cammed downwardly by the engaged hull surfaces as the boat is pulled through the device.

The intermediate brushes 79 and side brushes 70 overlap one another transversely so they will clean a continuous swath along the hull of the boat. The individual brushes 70, 79 are pivoted on their own yoke assemblies so each may conform to the compound curvature of the boat hull.

The bottom brush assembly 33 functions to clean the longitudinal section 34 of the boat hull directly adjacent its keel, whether the boat has no keel, a shallow keel, or a prominent downwardly projecting keel. When a sailboat hull is being cleaned, the keel brushes 59 will function to clean the opposed vertical sides of the keel as the boat is moved through the device. The bottom brush arms 45 that mount the keel brushes will separate laterally due to contact between the keel, rollers 61, and the brushes 59. Cylinders 49, meanwhile urge the brushes 59 inwardly and firmly against the keel surfaces. If no prominent keel is provided the keel brushes 59 will merge to the position shown in FIG. 2. When the keel brushes contact one another, the bottom brushes also touch tangentially at their inward ends to engage and extend completely across the hull bottom surface 34, whether it includes a shallow keel or no keel at all.

It is understood that the present device will require periodic maintenance or repair work. For this purpose we provide the movably interconnected frameworks 18 and 23 that enable the brush assemblies to be elevated above the water surface 90 (FIG. 2) to the more accessable inoperative position (FIG. 2). It is also preferable to elevate the brush assemblies when the device is not in use to prevent corrosion, especially in salt water.

It is to be understood that the above description and the attached drawings are given merely by way of example to set forth a preferred form of the present invention. The following claims are intended to more restrict the scope of our invention.

What we claim is:

1. A device for cleaning the hull of a boat while moving the boat in a forward direction along a prescribed path through the device, comprising:

an open framework having opposed transverse ends joined by longitudinal sides;

a bottom brush arm pivotably mounted to one end of the framework and extending therefrom along the path to an outer end thereof, the bottom brush arm being pivoted about an axis transverse to and directly below the prescribed path;

a bottom brush yoke mounted to the outer end of the bottom brush arm for pivotal movement thereon about an axis substantially parallel to the prescribed path;

a bottom brush rotatably mounted to the bottom brush yoke for rotation thereon about a rotational axis transverse to the prescribed path;

a pair of elongated side brush arms each pivotably mounted to said one end of the framework about upright axes transverse to the prescribed path, said side brush arms being individually located at opposite sides of the path and extending along the path to the outer ends thereof;

side brush yokes individually mounted to the outer ends of the respective side brush arms for pivotal movement thereon about axes substantially parallel to the prescribed path;

side brushes mounted to the side brush yokes for rotational movement thereon about upright axes substantially transverse to the prescribed path; said side brushes being longitudinally spaced from said bottom brush;

a pair of intermediate brush arms each pivotably mounted at said one end of the framework and extending along the path between the bottom brush arm and each of said side brush arms to outer ends thereof longitudinally staggered with respect to the outer ends of the bottom and side brush arms, said intermediate brush arms being pivoted about axes substantially transverse to and situated below the prescribed path;

intermediate brush yokes mounted to the outer ends of the intermediate brush arms for pivotal movement about axes substantially parallel to the prescribed path;

intermediate brushes mounted to the intermediate brush yokes for rotation thereon about axes transverse to the prescribed path;

wherein the bottom, intermediate and side brushes overlap one another transversely across the prescribed path;

means for rotating the bottom, intermediate and side brushes about their respective rotational axes;

individual biasing means between the framework and each of the respective bottom, intermediate and side brush arms for yieldably urging the individual arms toward the prescribed path; and means for moving a boat in a forward direction along the prescribed path past the bottom, intermediate and side brushes.

2. The device as defined by claim 1 wherein a pair of the bottom brush arms, yokes and brushes are individually pivotably mounted to said one end of the framework about parallel upright axes and further comprising:

a pair of upright keel brush yokes individually mounted to the outer ends of the respective bottom brush arms; and individual keel brushes mounted to the keel brush yokes for rotation thereon about parallel upright axes.

3. The device as defined by claim 2 wherein the bottom brushes include adjacent inward and transversely spaced outward ends and wherein the keel brush yokes are situated below the inner ends of the bottom brushes with respect to the prescribed path.

4. The device as defined by claim 3 wherein the individual keel brush yokes are fixed to the respective bottom brush arms.

5. The device as defined by claim 1 wherein the framework includes:

a stationary bottom supported frame;

a hull cleaner frame mounted to the bottom supported frame for elevational movement thereon; and hoist means interconnecting the hull cleaner frame and the bottom supported frame for selectively moving the hull cleaner frame elevationally between a submerged operative position and an above surface inoperative position;

wherein the bottom, intermediate and side brush arms are mounted to the hull cleaner frame.

6. The device as defined by claim 1 wherein the bottom, intermediate and side brush arms extend forwardly from the one frame end along the prescribed path with respect to the forward direction of travel.

7. The device as defined in claim 1 wherein a pair of bottom brush arms, yokes, and brushes are provided in transverse spaced relation on the frame in relation to the prescribed path and wherein the bottom brush yokes include adjacent inner ends pivotably connected to the bottom brush arms and transversely spaced outer ends, and further comprising:

means interconnecting the respective bottom brush yokes and bottom brush arms for urging the outer ends of the individual bottom brush yokes about their respective pivot axes toward the prescribed path.

8. The device as defined by claim 1 further comprising guide rollers rotatably mounted to the bottom brush yoke, the intermediate brush yokes and side brush yokes for engaging and rolling against the hull of a boat being moved through the device.

9. The device as defined by claim 1 wherein the side brush yokes are freely pivoted to the outward ends of the side brush arms about horizontal pivot axes and wherein the horizontal pivot axes for the side brush yokes are elevationally over-centered on the side brush yokes so they will normally pivot to upright positions with the rotational axes of the side brushes being vertical.

10. The device as defined by claim 1 wherein each of the bottom, intermediate and side brushes are cylindrical and wherein the means for rotating the brushes is comprised of a hydraulic motor for each brush.

11. The device as defined by claim 10 wherein the biasing means is comprised of individual hydraulic cylinders mounted between the frame end and the respective bottom, intermediate and side brush arms.

12. The device as defined by claim 11 further comprising:

means operably connected between said hydraulic motors and said hydraulic cylinders in a series hydraulic circuit for operating them simultaneously.

13. The device as defined by claim 1 wherein the biasing means is comprised of individual hydraulic cylinders mounted between the frame and each of the respective bottom, intermediate and side brush arms.

* * * * *